United States Patent [19]

Deborde et al.

[11] Patent Number: 4,512,375

[45] Date of Patent: Apr. 23, 1985

[54] SYSTEM FOR ALTERNATELY INSERTING DIFFERENT WEFT YARNS INTO THE SHED OF A JET LOOM

[75] Inventors: Albert H. Deborde; Pierre Rémond, both of Bourgoin Jallieu, France

[73] Assignee: Saurer Diederichs Societe Anonyme, Bourgoin Jallieu, France

[21] Appl. No.: 549,929

[22] Filed: Nov. 8, 1983

[30] Foreign Application Priority Data

Nov. 9, 1982 [FR] France ..... 82 19105

[51] Int. Cl.[3] ..... D03D 47/38

[52] U.S. Cl. ..... 139/435; 139/450; 139/453

[58] Field of Search ..... 139/435, 450, 453; 226/97

[56] References Cited

U.S. PATENT DOCUMENTS

| | | | |
|---|---|---|---|
| 3,482,606 | 12/1969 | Mizuno et al. | 139/435 |
| 3,820,574 | 6/1974 | Mizuno | 139/435 |
| 4,134,435 | 1/1979 | Cornellier | 139/435 |
| 4,241,766 | 12/1980 | Ushiro et al. | 139/435 |

FOREIGN PATENT DOCUMENTS

| | | |
|---|---|---|
| 0049297 | 10/1980 | European Pat. Off. . |
| 2147885 | 3/1973 | France . |
| 2362955 | 3/1978 | France . |
| WO82/02411 | 7/1982 | PCT Int'l Appl. . |
| 903466 | 8/1962 | United Kingdom . |
| 1170812 | 11/1969 | United Kingdom . |

*Primary Examiner*—Henry S. Jaudon

*Attorney, Agent, or Firm*—Karl F. Ross; Herbert Dubno

[57] ABSTRACT

A distributing unit synchronized with the shed-forming operation of a jet loom is positively coupled with a rocker arm carrying two insertion nozzles which are respectively aligned with the shed during alternate operating cycles, this unit temporarliy admitting high-pressure air to the currently aligned nozzle and to an associated thread clamp for the release of a weft yarn engaged thereby. The distributing unit comprises two interconnected outer disks bracketing an inner disk on a fixed axle on which the outer disks are held substantially immovable by a friction brake; the inner disk is limitedly rotatable by a cam-operated lever swingable about that axle and, in each of two working positions, connects two inlets for high-pressure air on one outer disk to respective outlets on the other outer disk leading to the currently aligned nozzle and to the associated thread clamp. The lever is connected with the inner disk by a stud which passes through a cutout in one of the outer disks having a width corresponding to the swing of the stud, thereby performing an initial angular adjustment of the outer disks relative to the inner disk.

18 Claims, 8 Drawing Figures

SYSTEM FOR ALTERNATELY INSERTING DIFFERENT WEFT YARNS INTO THE SHED OF A JET LOOM

FIELD OF THE INVENTION

Our present invention relates to a system for inserting a plurality of different weft yarns in a predetermined sequence into a shed of a so-called jet loom, i.e. a loom of the shuttleless type operating with pneumatic insertion.

BACKGROUND OF THE INVENTION

The alternation between different weft yarns in such a loom requires the operative alignment of the respective insertion nozzles in a certain sequence with the shed-forming means of the loom, e.g. as known from U.S. Pat. No. 4,326,565. The nozzles are generally mounted for this purpose on a mobile carrier such as a rocker arm which is pivoted on an extension of the batten or sley near one end of a guide channel formed by the warp-engaging heddles or by so-called confiners interleaved therewith (see, for example, our commonly owned application Ser. No. 331,922 filed Dec. 17, 1981, now U.S. Pat. No. 4,448,223 issued May 15, 1984). The mobile carrier is, of course, synchronized with the loom cycle so that the insertion of a pick, i.e. a section of the weft yarn, can be initiated as soon as the shed has been reformed. Generally, it is also necessary to provide each nozzle with an associated thread clamp which immobilizes a cut-off end of the corresponding weft yarn until the nozzle is activated by a blast of air under pressure to insert another pick.

Thread clamps such as those here considered include a fixed and a movable jaw, the latter being conventionally operable by a single-acting pneumatic jack to which air under pressure is applied when the clamp is to close around the weft yarn. When the air pressure is relieved, a countervailing biasing spring reopens the clamp. When the clamp-operating air and the weft-injecting air are derived from the same source, such as a compressor or an accumulator, the air pressure available for holding one of the clamps closed is subject to variation as another nozzle is activated during that period; this could lead to a premature release of an engaged weft yarn which might then become entangled with the one selected for insertion. Moreover, the reopening of the clamp by means of a biasing spring is somewhat sluggish so that the release of the engaged weft yarn occurs with a certain delay after the air pressure has been relieved.

OBJECT OF THE INVENTION

The object of our present invention, therefore, is to provide an improved system for the joint control of the sequential operation of two or more insertion nozzles and associated thread clamps in proper correlation with the shed-forming mechanism of the loom.

SUMMARY OF THE INVENTION

Such a system, in accordance with our present invention, comprises distributor means positively coupled with weft-selection means by which the several insertion nozzles are alternately placed in an alignment position, the distributor means temporarily connecting a source of high-pressure air to the insertion nozzle placed in the alignment position and concurrently therewith to the associated thread clamp for releasing the weft yarn engaged thereby. Thus, the mode of operation of each thread clamp is the converse of the aforedescribed conventional mode in that these clamps are normally held closed by passive biasing means such as springs and are opened only when high-pressure air is applied thereto. Since not more than one clamp is to be open at any time, and since the unclamping period is only a fraction of a loom cycle, the source of pressurized air can be of limited capacity independent of the number of selectively activable insertion nozzles.

Pursuant to a more particular feature of our invention, the distributor means is a unit advantageously comprising two stationary gating members bracketing a movable gating member, these gating members being preferably designed as disks mounted on a common axle. The stationary gating members or outer disks have first and second inlet ports connected to the source of high-pressure air as well as first and second pairs of outlet ports respectively connected to the injection nozzles and to the thread clamps; each pair of outlet ports is disposed on the stationary member opposite to one provided with the corresponding inlet port. The movable gating member or inner disk is displaceable between one working position, establishing flow paths from the first inlet port to one outlet port of the first pair and from the second inlet port to one outlet port of the second pair, and another working position, establishing flow paths from the first inlet port to the other outlet port of the first pair and from the second inlet port to the other outlet port of the second pair. For simplicity of manufacture and assembly, it will be convenient to provide the two inlet ports on one outer disk and the two pairs of outlet ports on the other outer disk.

In the specific instance in which the distributing unit serves only two nozzles and associated thread clamps, the inner disk will have but two working positions which can be separated by a small angle and correspond to limiting positions of a control lever pivoted on the disk-supporting axle, that lever being advantageously coupled with the inner disk by a stud passing through a cutout in an adjoining outer disk. The width of that cutout may correspond to the swing of the control lever so that a boundary thereof abuts the connecting stud in each of the two limiting positions. With the outer disks jointly rotatable about the axle against the resistance of a friction brake fixed to that axle, an initial angular adjustment of their position relative to the inner disk will automatically occur by coaction of the stud with the boundary of the cutout during a first operating cycle. The two outer disks can be interconnected in that case by a pin traversing with clearance a hole in the inner disk.

It will be understood that suitable flow-control means such as a solenoid valve may be interposed in the connection between the source of high-pressure air and the inlet ports of the distributing unit for letting the air reach the selected nozzle and thread clamp only during the time of actual insertion. The reclamping of the temporarily released weft yarn will therefore occur upon the discontinuation of the air supply by the control valve rather than by a changeover in the position of the movable gating member.

BRIEF DESCRIPTION OF THE DRAWING

The above and other features of our invention will now be described in detail with reference to the accompanying drawing in which.

SPECIFIC DESCRIPTION

Figure 1:
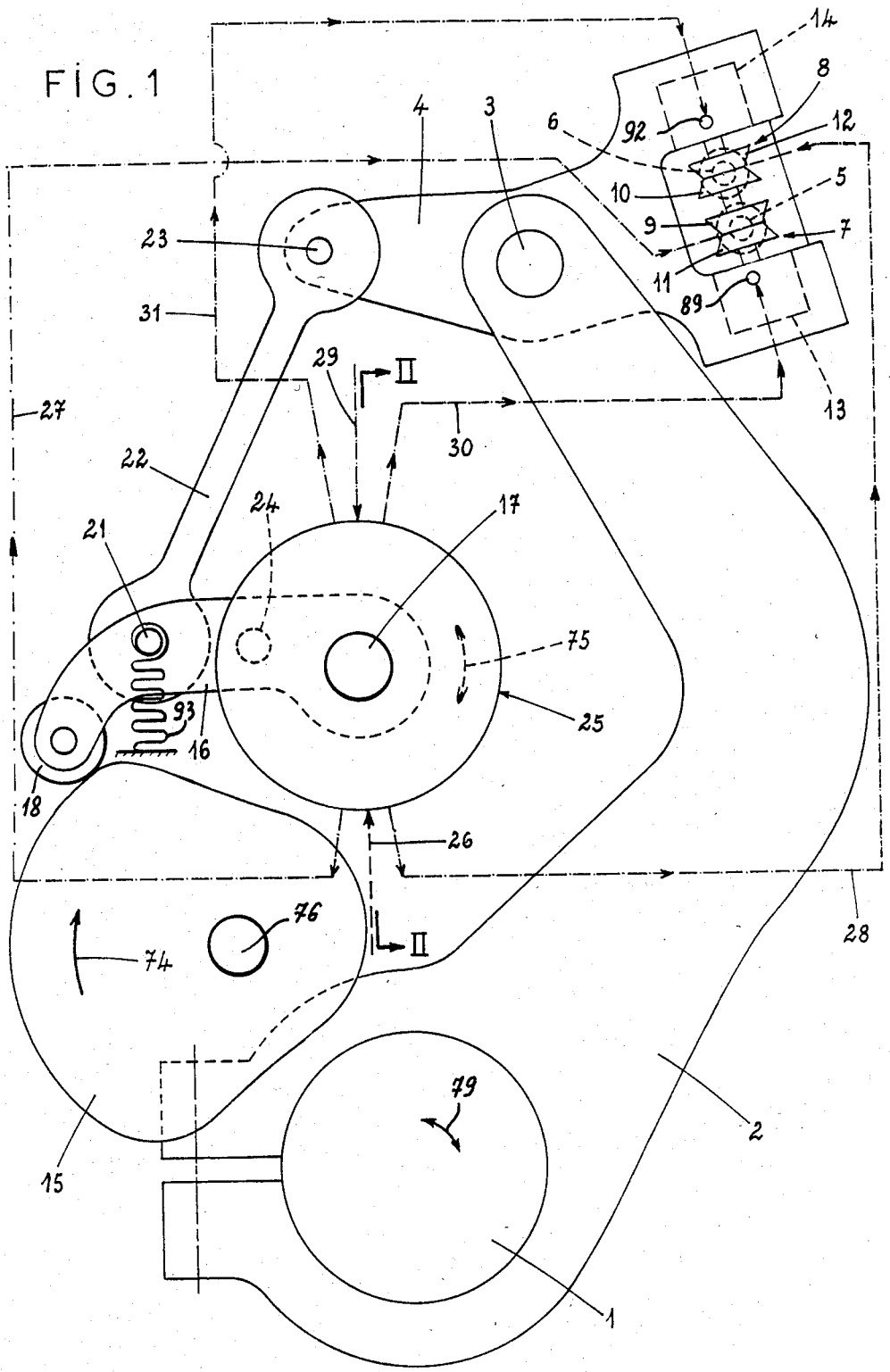
FIG. 1 is a somewhat diagrammatic elevational view of a preferred embodiment comprising a nozzle carrier, a distributing unit and a cam drive therefor.
Figure 8:
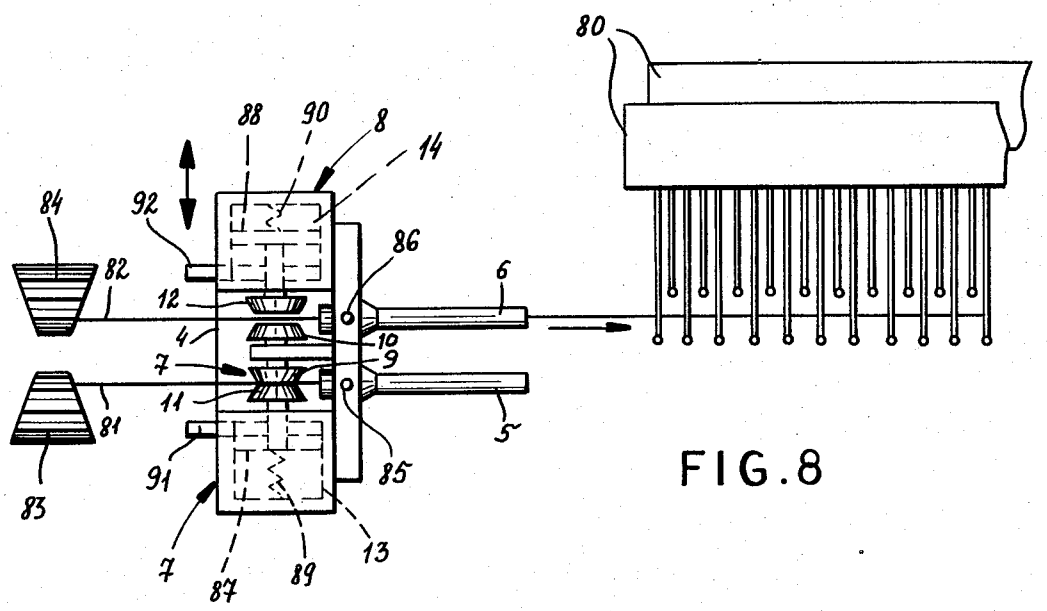
FIG. 8 schematically shows the combination of the nozzle carrier of FIG. 1 with a shed-forming mechanism of a jet loom.

FIG. 1 shows a shaft 1, oscillated about its axis by a nonillustrated crank drive, on which the sley (also not shown) of a jet loom is mounted and which supports an elbow-shaped arm 2 whose free end forms a fulcrum 3 for a rocker arm 4 serving as a carrier for a pair of parallel insertion nozzles 5 and 6. These nozzles, as seen in FIG. 8, can be alternately aligned with a shed formed in the usual manner between sets of warp threads which are suspended by heddles of vertically reciprocable harnesses 80. Rocker arm 4 also carries two thread clamps 7 and 8, respectively associated with nozzles 5 and 6, having fixed jaws 9, 10 and movable jaws 11, 12 between which respective weft yarns 81 and 82 pass from bobbins 83 and 84 to nozzles 5 and 6. These nozzles are provided with inlets 85 and 86 through which high-pressure air can enter to propel the respective weft yarn into the shed upon its release by the associated thread clamp. Upon such insertion, the weft yarn is severed at the output end of the nozzle by a nonillustrated cutter while the remainder is reclamped as the air flow is discontinued.

As illustrated somewhat schematically, the movable jaws 11, 12 of thread clamps 7 and 8 are carried on respective pistons 87 and 88 movable in cylinders 13 and 14 and biased toward the stationary jaws 9 and 10 by springs 89 and 90. Inlets 91 and 92 serve for the admission of air into cylinders 13 and 14 for the retraction of their pistons against the countervailing forces of their biasing springs. A particularly advantageous structure for such a thread clamp is the subject matter of a commonly owned application, Ser. No. 549,930, filed concurrently herewith by Albert Henri Deborde and Gilles Grandvallet.

FIG. 8 particularly illustrates the position in which, thanks to the simultaneous application of air pressure to inlets 86 and 92, thread clamp 8 is open and a section of weft yarn 82 is being inserted by nozzle 6 into the shed formed by harnesses 80. With thread clamp 7 closed, the end of weft yarn 81 is immobilized in nozzle 5.

A distributing unit 25, shown in FIG. 1 and more fully described hereinafter with reference to FIGS. 2–6, receives high-pressure air from a nonillustrated source (by way of a solenoid valve or similar control means synchronized with the harness motion as noted above) via a pair of incoming conduits schematically represented at 26 and 29. Similarly represented outgoing conduits 27 and 28 respectively extend from unit 25 to the inlets 85 and 86 (FIG. 8) of nozzles 5 and 6 while another pair of such outgoing conduits 30 and 31 lead from unit 25 to inlets 91 and 92 of thread clamps 7 and 8. Distributing unit 25, supported on a stationary axle 17, is controlled by a lever 16 whose free end carries a roller 18 which is held by a tension spring 93 against the periphery of a cam 15 mounted on a shaft 76. Cam 15 performs one clockwise revolution, as indicated by an arrow 74, during an oscillatory cycle of shaft 1 represented by an arrow 79. As a result of the continuous rotation of cam 15, lever 16 periodically swings about axle 17 through a small angle as indicated by an arrow 75.

Lever 16 is articulated by a pin 21 to a pitman 22 which in turn is articulated by a pin 23 to the end of rocker arm 4 remote from the extremity thereof that carries the nozzles 5, 6 and the thread clamps 7, 8. Cam 15 has a high dwell and a low dwell, each extending over roughly 120°, whereby nozzles 5 and 6 are respectively aligned with the shed of FIG. 8 for periods equal to about a third of a cam revolution. The air supply to conduits 26 and 29 is cut off while roller 18 contacts sloping zones of cam 15 interconnecting its two dwells.

Figure 2:
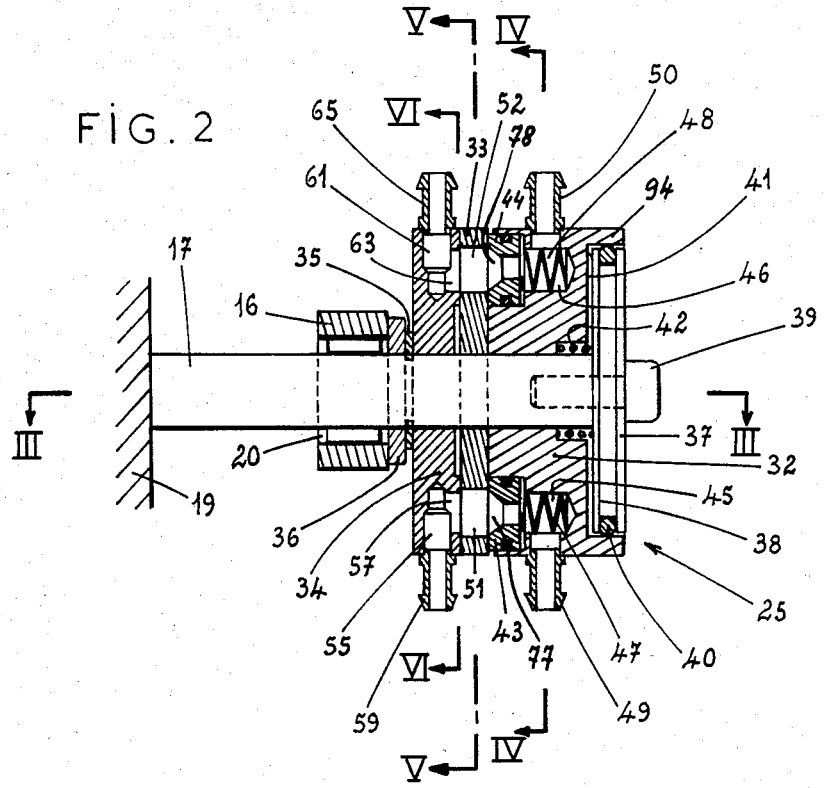
FIG. 2 is an axial sectional view of the distributing unit, taken on the line II—II of FIG. 1.
Figure 3:
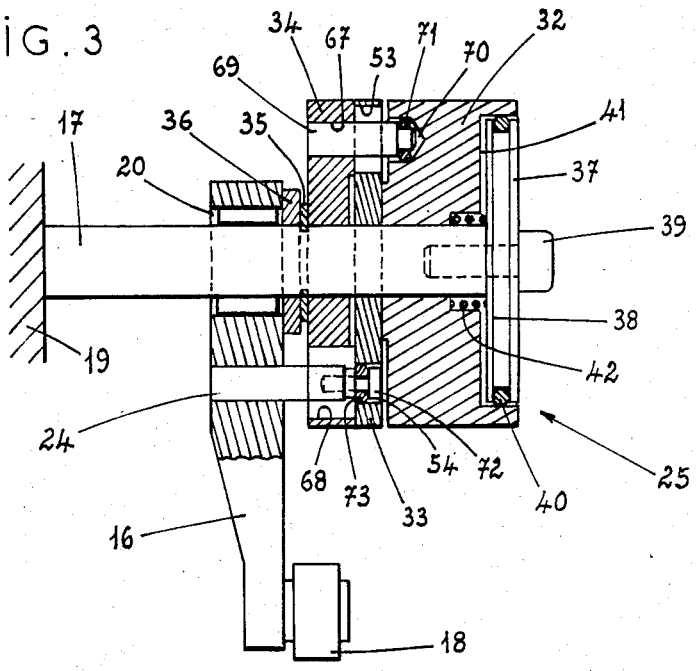
FIGS. 3, 4, 5 and 6 are sectional views respectively taken on lines III—III, IV—IV, V—V and VI—VI of FIG. 2.

As illustrated in FIGS. 2 and 3, axle 17 is cantilevered on a fixed support 19 forming part of the loom frame. Distributing unit 25 comprises three coaxially juxtaposed gating disks 32, 33 and 34, the two outer disks 32, 34 being frictionally immobilized on axle 17—by means described hereinafter—while the inner or middle disk 33 is limitedly rotatable on that axle under the control of lever 16 with which it is coupled by a stud 24. Lever 16 is separated from the adjoining disk 34 by a spacer ring 36 and a split ring or circlip 35, the latter engaging in an annular groove of axle 17 so as to form an abutment for the stack of disks 32–34. The outermost disk 32 has a recessed end face 41 bounded by an annular rim 94 which surrounds a friction brake in the form of a circular plate composed of a flat disk 37 and a stepped disk 38 defining between them a peripheral groove occupied by an elastic ring 40; the plate 37, 38 is held in position against the free end of axle 17 by a screw 39. Ring 40, compressed between the two constituent disks 37 and 38, is in frictional contact with the rim 94 so as to prevent any rotation of disk 32 about axle 17 except during an initial adjustment to be described. The recessed face 41 of disk 32 also forms a lodgment around axle 17 for a coil spring 42 which axially presses the stack 32–34 against the abutment 35. Lever 16 swings on a roller bearing 20.

Figure 4:
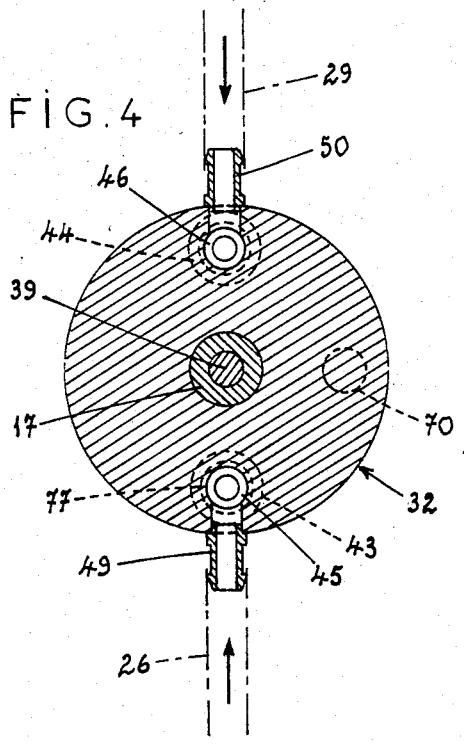

As seen in FIGS. 2 and 4, disk 32 is provided at diametrically opposite locations with a pair of lodgments 45 and 46 accommodating respective coil springs 47 and 48, these lodgments being open toward inner disk 33 and terminating in larger cylindrical recesses facing this inner disk. Two cylindrical inserts 43 and 44, provided with peripheral packing rings, are axially slidable in these recesses and have central apertures 77, 78 diverging frustoconically toward a confronting face of disk 33. Lodgments 45 and 46 communicate with respective inlet ports 49 and 50 to which the air-supply conduits 26 and 29 are attached as schematically indicated in FIG. 4.

Figure 5:
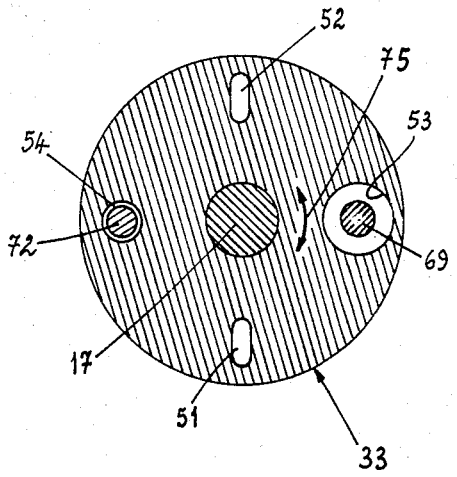

As shown in FIGS. 2 and 5, inner disk 33 has passages in the form of radial slots 51 and 52 respectively registering with apertures 77 and 78 of inserts 43 and 44. Disk 33 also has a large-diameter hole 53 and a small-diameter hole 54 at diametrically opposite locations offset by 90° from slots 51 and 52. Hole 53, as seen in FIGS. 3 and 5, is traversed with considerable play by a bolt 69 secured to disk 34, this bolt terminating in a reduced tip surrounded by a packing ring 71 which is received in a recess 70 of disk 32. Bolt 69 serves to interconnect the two disks 32, 34 in an angularly fixed relative position but with slight relative axial mobility whereby disk 34 is immobilized by friction brake 37–40 while disk 32 yields to the pressure of spring 42. Hole 54 forms a lodgment for the head of a screw 72 which is threaded into the free end of stud 24 and compresses a packing ring 73; stud 24 passes with clearance through a cutout 68 of disk 34 (see also FIG. 6) so as to couple the disk 33 with the lever 16 for joint oscillation about axle 17. The face of disk 32 confronting the disk 33 is peripherally recessed to allow for a certain axial mobility of disk 33 relative to stud 24 under the pressure of spring 42. The face of disk 34 confronting disk 33 is centrally recessed so as to leave a narrow annular contact zone between these two disks. All contact surfaces, including those of inserts 43 and 44, are highly polished to prevent leakages therebetween.

Figure 6:
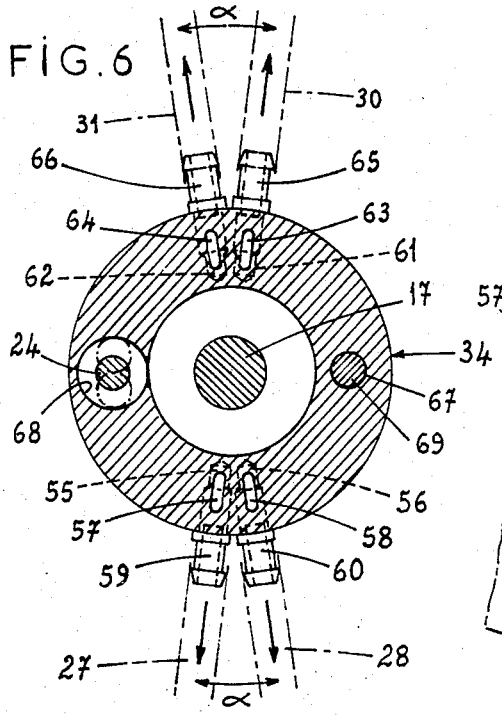
Figure 7:
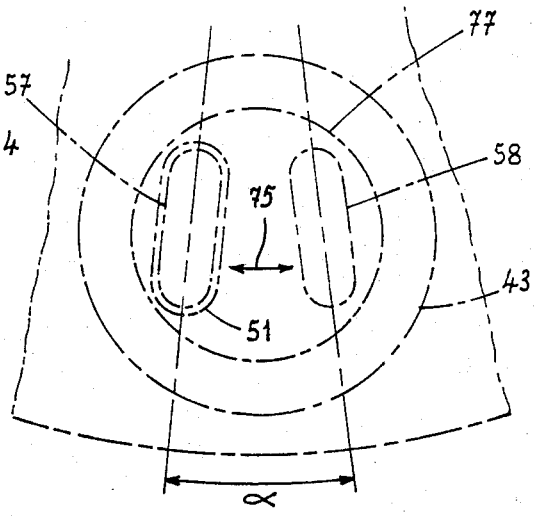
FIG. 7 is a diagrammatic representation of a sector of a gating disk forming part of the distributing unit.

Disk 34, as further shown in FIGS. 2 and 6, has two pairs of openings 57, 58 and 63, 64 closely spaced about a radial plane perpendicular to the one which bisects the cutout 68 and a diametrically opposite hole 67 in which the stud 24 is received with a force fit. The openings of each pair, which are also in the shape of radial slots, are separated from each other by a small angle $\alpha$ (e.g. between 10° and 20°) corresponding to the swing angle of lever 16 indicated by arrow 75 in FIGS. 1, 5 and 7. As diagrammatically shown in the latter Figure, opening 57 registers with slot 51 of disk 33 when that disk is in one of its two limiting positions; at the same time, the diametrically opposite opening 63 registers with slot 52. In the other limiting position of disk 33, openings 58 and 64 respectively register with slots 51 and 52. In either position, the slots 51 and 52 lie within the perimeters of apertures 77 and 78 so that a flow path exists from these apertures to the openings respectively aligned with slots 51 and 52. Openings 57, 58 and 63, 64, in turn, communicate via radial orifices 55, 56 and 61, 62 with respective outlet ports 59, 60, and 65, 66 to which outgoing conduits 27, 28 and 30, 31 are attached as schematically indicated in FIG. 6.

From FIG. 6 it will be seen that the diameter of the cutout 68 of disk 34 is so chosen that its circular boundary contacts the stud 24 in the two limiting positions of lever 16 as indicated by phantom lines. If, in a first operating cycle of the loom, the two mechanically interconnected outer disks 32 and 34 are angularly offset with reference to disk 33, the excursions of stud 24 will correct this deviation so as to align the apertures 77, 78 of disk 34 and the openings 57, 63 of disk 32 with the slots 51 and 52 of disk 33 in the manner discussed with reference to FIG. 7. The play afforded by hole 53 to bolt 69 should, of course, at least equal the clearance existing between cutout 68 and stud 24.

In its broader aspects, however, our invention is not restricted to two working positions of inner disk 33 corresponding to respective limits of the swing of control lever 16. Thus, the lever and the inner disk may have additional positions established by, say, a cam rotating more slowly than cam 15 in which the inlet ports 49 and 50 of disks 32 communicate by way of slots 51 and 52 in disk 33 and further openings of disk 34 with other outlets of the latter disk leading to further insertion nozzles and associated thread clamps. It will also be understood that control lever 16 or its equivalent is not necessarily cam-operated but may be displaceable, for example, with the aid of a fluidic jack. Structural details, such as the orientation of the various ports and the configuration of inserts 43, 44, are likewise subject to possible modifications.

We claim:

1. In a jet loom including shed-forming means, two insertion nozzles mounted on a mobile carrier for pneumatically introducing a respective weft yarn into a set of warp threads upon operative alignment with said shed-forming means, two thread clamps respectively associated with said insertion nozzles for temporarily retaining the corresponding weft yarns preparatorily to introduction thereof into the set of warp threads, and weft-selection means synchronized with said shed-forming means for alternatively placing said insertion nozzles in an alignment position, the combination therewith of distributor means positively coupled with said weft-selection means for temporarily connecting a source of high-pressure air to the insertion nozzle placed in said alignment position and concurrently therewith to the associated thread clamp for releasing the weft yarn engaged thereby, said distributor means comprising two stationary gating members and a movable gating member bracketed by said stationary gating members, said stationary gating members being provided with first and second inlet ports connected to said source and with first and second pairs of outlet ports, said first pair of outlet ports being disposed on the stationary gating member opposite the gating member provided with said first inlet port, said second pair of outlet ports being disposed on the stationary gating member opposite gating member provided with said second inlet port, said first pair of outlet ports being respectively connected to said thread clamps, said second pair of outlet ports being respectively connected to said insertion nozzles, said movable member being displaceable between one working position, establishing flow paths from said first inlet port to one outlet port of said first pair and from said second inlet port to one outlet port of said second pair, and another working position, establishing flow paths from said first inlet port to the other outlet port of said first pair and from said second inlet port to the other outlet port of said second pair.

2. The combination defined in claim 1 wherein said stationary gating members are two outer disks and said movable gating member is an inner disk closely juxtaposed on a common axle, said inner disk being limitedly rotatable about said axle.

3. The combination defined in claim 2 wherein said first and second inlet ports are both provided on one of said outer disks, said first and second pairs of outlet ports being provided on the other of said outer disks.

4. The combination defined in claim 3 wherein said one of said outer disks is provided with a first and a second recess on a face adjoining said inner disk, said first and second recesses respectively communicating with said first and second inlet ports and being occupied by inserts with apertures diverging toward said inner disk, said other of said outer disks being provided with two pairs of closely juxtaposed openings on a face adjoining said inner disk, said pairs of openings respectively communicating with said first and second pairs of outlet ports and confronting the diverging apertures of said inserts, said inner disk having two through-going passages aligned with respective openings of said pairs in each of said working positions.

5. The combination defined in claim 4 wherein said recesses, said openings and said passages are disposed at diametrically opposite locations on said disks.

6. The combination defined in claim 5 wherein said passages and said openings are in the form of radially extending slots, said diverging apertures being of frustoconical shape.

7. The combination defined in claim 4, further comprising spring means in said one of said outer disks urging said inserts into contact with said inner disk.

8. The combination defined in claim 4, further comprising a control lever pivoted on said axle and coupled with said weft-selection means for swinging between two limiting positions, said control lever being coupled with said inner disk by a stud passing through a cutout in an adjoining outer disk.

9. The combination defined in claim 8 wherein the working positions of said inner disk correspond to the limiting positions of said control lever, the width of said cutout corresponding to the swing of said control lever whereby said stud abuts a boundary of said cutout in each of said limiting positions.

10. The combination defined in claim 9 wherein said outer disks are jointly rotatable about said axle against resistance of a friction brake rigid with said axle, thereby enabling an initial angular adjustment of said outer disks relative to said inner disk by coaction of said stud with said boundary.

11. The combination defined in claim 10 wherein said axle is cantilevered on a stationary support, said lever being interposed between said support and a closer one of said outer disks, the more remote outer disk being provided with a rim facing away from said inner disk, said friction brake being secured to a free end of said axle for coaction with said rim, said outer disks being positively interconnected for joint rotation.

12. The combination defined in claim 11 wherein said friction brake comprises a circular plate with a peripheral groove containing an elastic ring surrounded by said rim.

13. The combination defined in claim 12 wherein the connection between said outer disks is constituted by a bolt traversing with clearance a hole in said inner disk.

14. The combination defined in claim 13 wherein said bolt and said stud enable a relative axial displacement of said disks, further comprising resilient means interposed between said circular plate and said more remote outer disk urging said inner and outer disks toward an abutment on said axle.

15. The combination defined in claim 14 wherein said abutment is a split ring engaging said axle between said disks and said control lever.

16. The combination defined in claim 12 wherein said bolt and said stud are disposed at diametrically opposite locations offset from said recesses, said openings and said passages.

17. The combination defined in claim 8 wherein said carrier is a rocker arm mechanically linked with said control lever for joint oscillation about respective fulcra.

18. The combination defined in claim 8 wherein said weft-selection means comprises a cam coacting with said control lever.

* * * * *